US008042592B2

(12) United States Patent
Crawford et al.

(10) Patent No.: US 8,042,592 B2
(45) Date of Patent: Oct. 25, 2011

(54) TAPE DISPENSER

(75) Inventors: Dennis L. Crawford, Roberts, WI (US); Scott D. Gullicks, Apple Valley, MN (US); Peter J. Newbould, Milan (IT); Sigurdur Thorsteinsson, Milan (IT)

(73) Assignee: 3M Innovative Properties Company, St. Paul, MN (US)

( * ) Notice: Subject to any disclaimer, the term of this patent is extended or adjusted under 35 U.S.C. 154(b) by 1019 days.

(21) Appl. No.: 11/390,011

(22) Filed: Mar. 27, 2006

(65) Prior Publication Data

US 2007/0221336 A1 Sep. 27, 2007

(51) Int. Cl.
*B65H 35/00* (2006.01)

(52) U.S. Cl. ..... 156/577; 156/579

(58) Field of Classification Search ..... 156/523, 156/526, 527, 574, 579, 577; 225/46, 47
See application file for complete search history.

(56) References Cited

U.S. PATENT DOCUMENTS

| | | | | |
|---|---|---|---|---|
| 3,972,769 | A | 8/1976 | Lissoni | |
| D280,738 | S | 9/1985 | Grassi | |
| 4,627,560 | A | 12/1986 | Samuelson | |
| 4,762,586 | A | 8/1988 | Wilkie | |
| D326,474 | S | 5/1992 | Luhman et al. | |
| D333,678 | S | 3/1993 | Lissoni | |
| 5,468,332 | A | 11/1995 | Dretzka et al. | |
| 5,641,377 | A | 6/1997 | Chung et al. | |
| D385,265 | S | 10/1997 | Knowles et al. | |
| 5,707,482 | A * | 1/1998 | Fusselman | 156/577 |
| 5,759,342 | A | 6/1998 | Luhman et al. | |
| 5,792,310 | A | 8/1998 | Thompson et al. | |
| D412,820 | S | 8/1999 | Lee | |
| D414,171 | S | 9/1999 | Swift et al. | |
| 6,098,690 | A | 8/2000 | Robichaud | |
| 6,170,395 | B1 | 1/2001 | Lee | |
| D446,524 | S | 8/2001 | Bontly et al. | |
| D454,911 | S | 3/2002 | Carlson et al. | |
| D456,808 | S | 5/2002 | Fitch et al. | |
| D459,728 | S | 7/2002 | Roberts et al. | |
| D470,145 | S | 2/2003 | Schlieffers et al. | |
| D470,497 | S | 2/2003 | Byun et al. | |
| 6,721,997 | B2 * | 4/2004 | Hua | 16/431 |
| 7,021,356 | B2 * | 4/2006 | Kelders et al. | 156/523 |

(Continued)

FOREIGN PATENT DOCUMENTS

EP 1 190 973 A2 3/2002

(Continued)

OTHER PUBLICATIONS

Actuate (definition) [online], [retrieved on Mar. 29, 2010], retrieved from Dictionary.com (http://dictionary.reference.com/browse/actuate).*

*Primary Examiner* — Matthew Daniels
*Assistant Examiner* — Yana Belyaev
(74) *Attorney, Agent, or Firm* — Lisa P. Fulton

(57) ABSTRACT

A tape dispenser including a cutting mechanism is disclosed that allows for improved access to the mandrel during reloading. The tape dispenser comprises a base, a cover, and a mandrel disposed within the base and cover. The cover is capable of securely engaging with the base. The base, the cover, and the mandrel are connected along a pivot point. The cover actuates the mandrel to an open, loading position.

12 Claims, 4 Drawing Sheets

U.S. PATENT DOCUMENTS

| | | | |
|---|---|---|---|
| D520,061 | S | 5/2006 | Daunter et al. |
| D523,084 | S | 6/2006 | Wojtkun et al. |
| D523,478 | S | 6/2006 | Wojtkun et al. |
| 7,195,048 | B2 | 3/2007 | Wojtkun et al. |
| 2002/0056526 | A1 | 5/2002 | Kelders et al. |
| 2004/0244917 | A1 | 12/2004 | Wojtkun et al. |
| 2005/0224554 | A1 * | 10/2005 | Kirby et al. ..... 227/134 |
| 2006/0169709 | A1 | 8/2006 | Bailey et al. |

FOREIGN PATENT DOCUMENTS

| | | | |
|---|---|---|---|
| JP | 2003-127593 | A | 5/2003 |
| WO | WO 2005/113397 | A1 | 12/2005 |

* cited by examiner

TAPE DISPENSER

FIELD

The present invention relates to a tape dispenser. In particular, the present invention relates to a tape dispenser that includes a mandrel that moves with respect to movement of a cover on the tape dispenser.

BACKGROUND

Tape dispensers can be provided to a user in a disposable form or a reusable form. In the disposable form, typically the user does not have access to the mandrel to replace the used roll of tape with a new roll of tape. Therefore, when the tape is completely used, the entire tape dispenser is discarded.

In a reusable form of a tape dispenser, the user is able to replace the used roll of tape with a new roll of tape. The user is able to remove what is remaining of the used roll and only discard that portion, which usually is just the support core for the tape film. Then, the user will replace only the roll of tape, which typically includes a new support core for the tape film, onto the mandrel of the tape dispenser.

Often replacing the tape roll can be a complicated and difficult task, particularly in mailing and packaging tape dispensers. The user must access the spindle on the mandrel that supports the tape roll, insert a new roll, and feed the tape film through the dispenser to have the end of the tape ready for use at the discharge end of the dispenser. If the dispenser is relatively small, it may be difficult to accomplish each of these tasks in the relatively small area of the tape dispenser. Increasing the size of the dispenser will typically make reloading easier because a larger area allows easier access to the larger tape dispenser. However, a larger tape dispenser will typically be heavier and will take up more storage space.

SUMMARY

A tape dispenser including a cutting mechanism is disclosed that allows for improved access to the mandrel during reloading. In one embodiment, the tape dispenser comprises a base, a cover, and a mandrel disposed within the base and cover. The cover is capable of securely engaging with the base. The base, the cover, and the mandrel are connected along a pivot point. The cover actuates the mandrel to an open, loading position.

In another embodiment, the tape dispenser includes a cutting mechanism and further comprises a base, a cover capable of engaging with the base, a tape discharge end when the cover is engaged with the base, and a mandrel disposed within the base and cover and including a spindle for supporting a roll of tape and a rear face plate. The base, cover and mandrel are connected along a pivot point distal the tape discharge end. When the cover contacts the rear face plate of the mandrel, the cover actuates the mandrel to an open, loading position.

In another embodiment, the tape dispenser comprises a housing and a mandrel. The housing comprises a base having a bottom surface and two projecting sidewalls further includes a lock opening and a handle, a cover having a top surface and two projecting sidewalls further includes a cutting mechanism and a lock projection that is capable of engaging with the lock opening, and a tape discharge end adjacent the cutting mechanism when the cover and base are engaged. The mandrel is disposed within the housing and includes a spindle for supporting a roll of tape and a rear face plate. The base, cover and mandrel are connected along a pivot point opposite the tape discharge end. The cover contacts the rear face plate of the mandrel to actuate the mandrel between a closed, dispensing position and an open, loading position.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
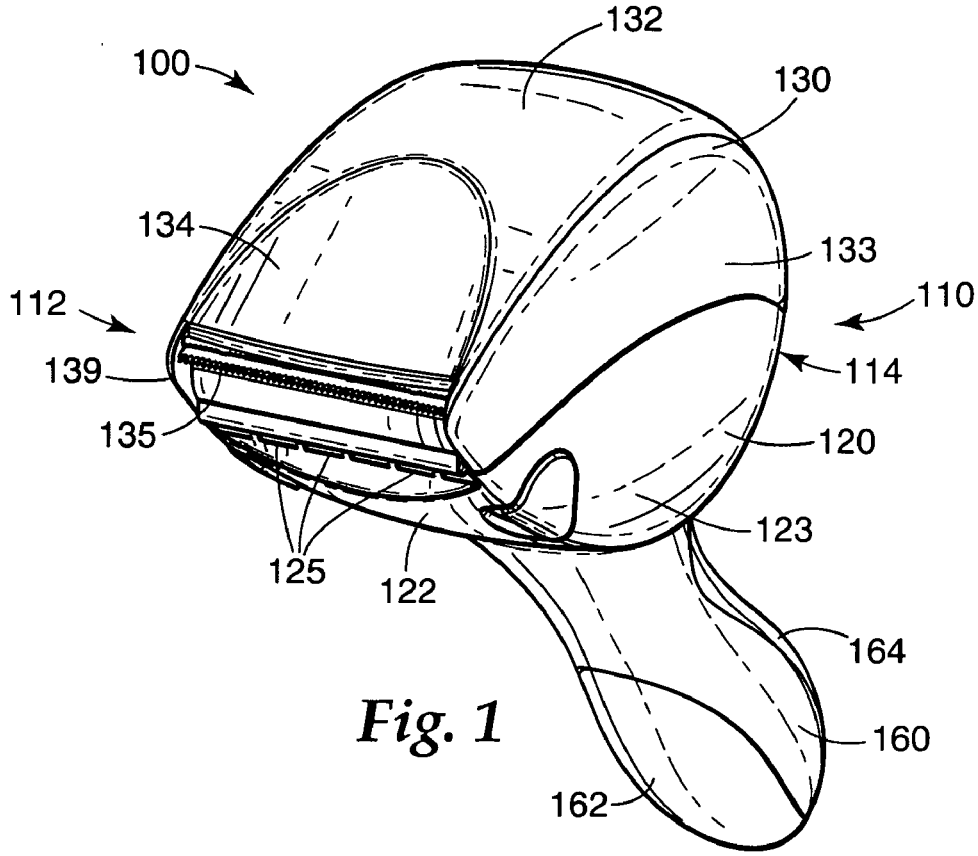
FIG. 1 is a perspective view of an embodiment of a tape dispenser of the present invention.
Figure 2:
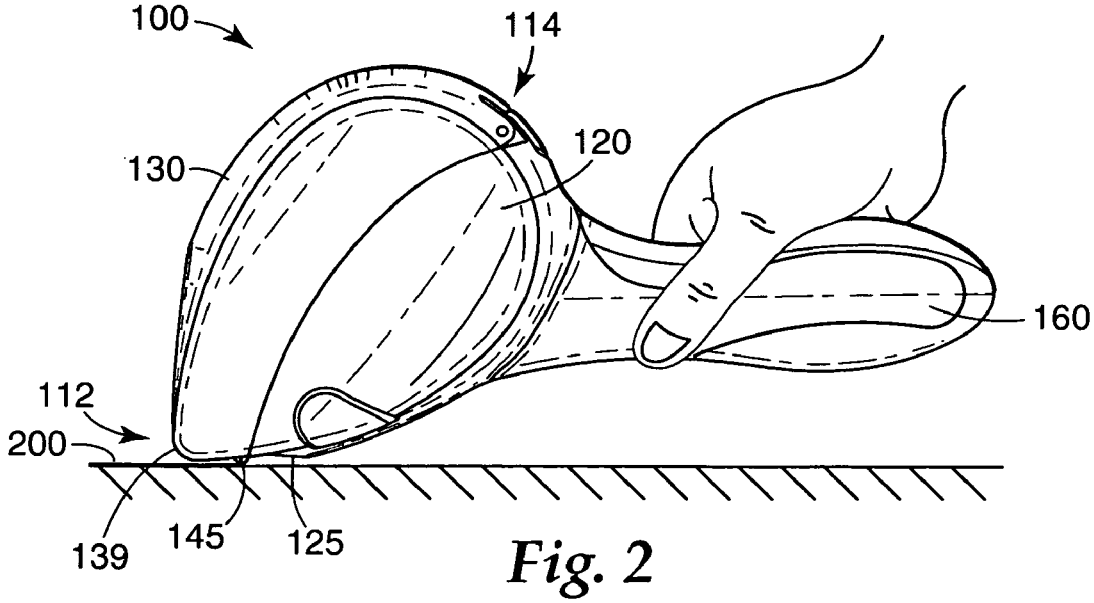
FIG. 2 is a side view of the tape dispenser of FIG. 1 in use.
Figure 3:
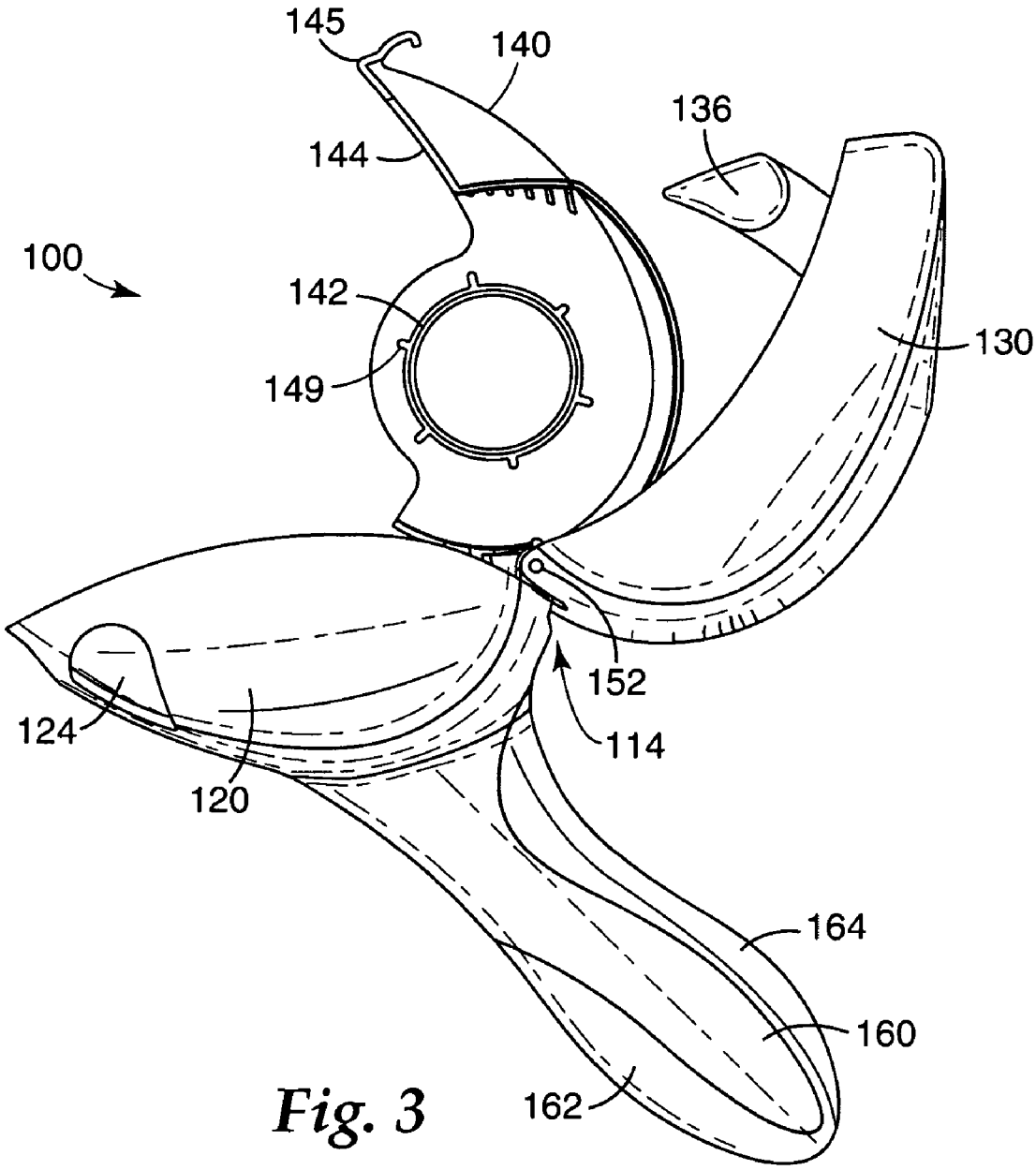
FIG. 3 is a side view of the tape dispenser of FIG. 1 in an open position.

FIG. 1 is a perspective view of an embodiment of a tape dispenser 100 of the present invention. FIG. 2 is a side view of the tape dispenser of FIG. 1 in use. FIG. 3 is a side view of the tape dispenser of FIG. 1 in an open position.

Figure 4:
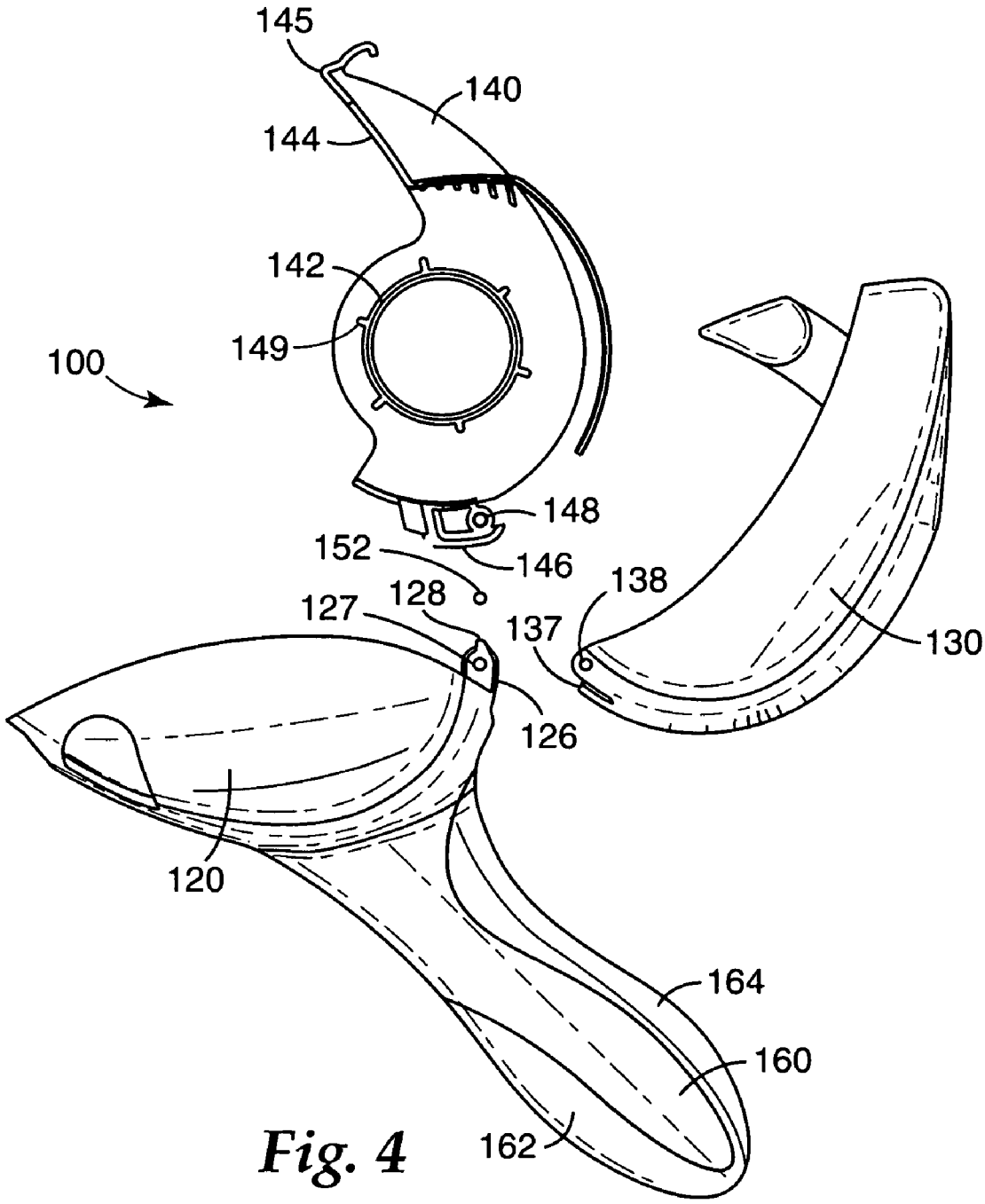
FIG. 4 is a side exploded view of the tape dispenser of FIG. 3.

The tape dispenser 100 includes a base 120, a cover 130, and a mandrel 140 (see FIGS. 3 and 4). As shown in the embodiment of FIG. 1, the base 120 and cover 130 form a housing 110 to contain the mandrel 140 within the housing 110.

As shown in FIG. 1, the housing 1 10 of the tape dispenser 100 is in a closed position. The housing 110 includes a tape dispensing end 112 and a pivot end 114. The tape dispensing end 112 is the end of the tape dispenser 100 where the tape exits the housing 1 10 and is available for application to a surface, such as shown in FIG. 2. The pivot end 114 is distal the tape dispensing end 112 and is the end of the tape dispenser 100 where the base 120, cover 130, and mandrel 140 connect to one another, as will be discussed in detail below.

The base 120 includes a lower surface 122 and lower sidewalls 123 that project from the lower surface 122 to form a portion of the housing 110. In the embodiment shown, lock openings 124 are included in each of the lower sidewalls 123 near the tape dispensing end 112. Although, two lock openings 124 are shown, it is understood that only one, or more than two can be included.

The cover 130 includes an upper surface 132 and upper sidewalls 133 that project from the upper surface 132 to form a portion of the housing 110. Generally, the upper surface 132 of the housing is an arc-like shape that is smooth without indentations or depressions. However, the tape dispenser 100 may include wipe down surface 134 on the cover. Wipe down surface 134 is a planar surface that provides a surface on the tape dispenser 100 to assist with adding friction to ensure between the tape and the surface that the tape is being adhered to. The wipe down surface 134 is particularly suited for closing boxes and making contact between the tape and the vertical surface of the box.

A cutting mechanism 135 is located at the tape dispensing end 112 of the cover 130. The cutting mechanism 135 typically is a blade that may be metal or plastic. However, other suitable cutting mechanisms 135 are within the scope of the invention. Sidewall projections 139 are located at the dispensing end 112 of the cover 130 on each side of the cutting mechanism 135 to prevent the cutting mechanism 135 from contacting the surface that the tape 200 is being adhered to. As can be seen in the side view from FIG. 2, the sidewall projections 139 completely cover from view the cutting mechanism 135.

In the embodiment shown, lock projections 136 are included and extend from each of the upper sidewalls 133 near the tape dispending end 112. The lock projections 136 align with the lock openings 124 of the base 120 such that when the cover 130 is in a closed position, as shown in FIG. 1, the lock projections 136 enter the lock openings 124 and engage with the lock openings 124 to prevent the cover 130 from releasing from the base 120.

To open the tape dispenser 100 and release the lock projections 136 from engagement with the lock openings 124, the lock projections 136 passing through the lock openings 124 are pressed and disengaged to allow the cover 130 to open, as shown in FIG. 3. As shown, there is one lock opening 124 for each lock projection 136. Any number of lock opening 124 and lock projection 136 pairs may be included. Further, other types of locking mechanisms are within the scope of the invention.

The mandrel 140 is contained within the base 120 and cover 130 as shown in FIGS. 1 and 2. When the tape dispenser 100 is in an open position, as shown in FIG. 3, the mandrel 140 is accessible. The mandrel 140 includes a spindle 142 that supports a tape roll, which is not shown for ease of viewing the mandrel 140. On the spindle 142 are at least three standing ribs 149. The standing ribs 149 are sized to create a slight interference fit with the inside of that tape roll core (not shown), so as to create drag (rotational resistance) on the tape core as the tape is unwound from the tape dispenser 100. The degree of interference is specifically designed to provide tension on the unwound tape length to facilitate application and cutting of the tape 200.

Near the tape dispensing end 112, when the base 120 and cover 130 are in a closed position, the mandrel 140 includes a guide 144 that the dispensing tape runs adjacent to. A wipe down ridge 145 is included on the mandrel 140, and is visible in FIG. 2, to allow the dispensed tape to be firmly pressed against a surface before the dispensed tape is cut with the cutting mechanism 135.

FIG. 4 is a side exploded view of the open tape dispenser 100 of FIG. 3. The base 120 includes a pivot projection 126 at the pivot end 114. The pivot projection 126 includes a base pivot opening 127 therethrough. The cover 130 includes a cover pivot opening 138, and the mandrel 140 includes a mandrel pivot opening 148. A pivot pin 152 passes through the base pivot opening 127, the cover pivot opening 138 and the mandrel pivot opening 148 to connect the base 120, cover 130, and mandrel 140 at a single pivot point. Although the embodiment shown in FIGS. 3 and 4 include openings through each of the base 120, cover 130, and mandrel 140 through which a pin 152 passes to connect these parts as a single pivot point, other types of connections are possible so long as the base 120, cover 130, and mandrel 140 are connected to one another at a single rotation point.

Figure 5:
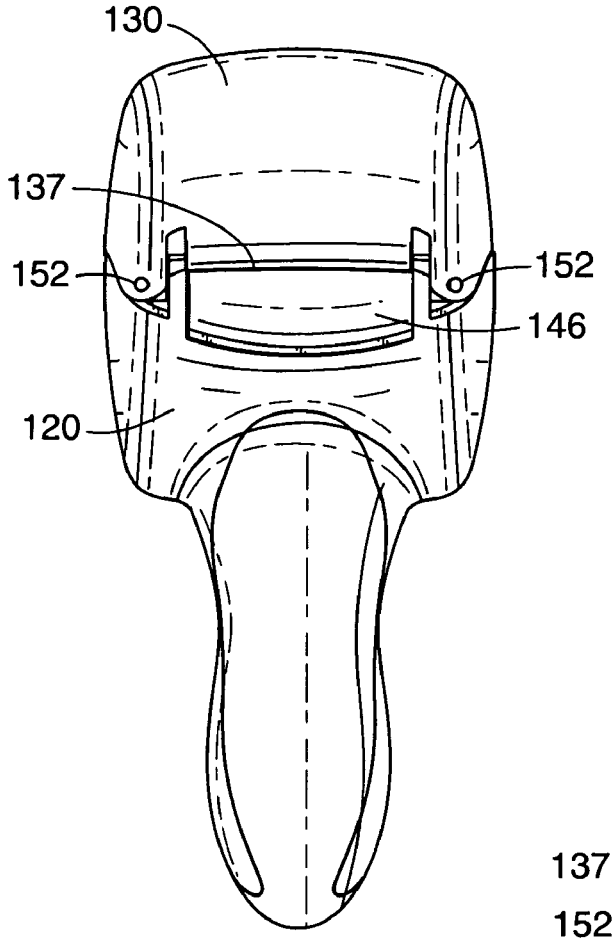
FIG. 5 is a rear view of the tape dispenser of FIG. 1.
Figure 6:
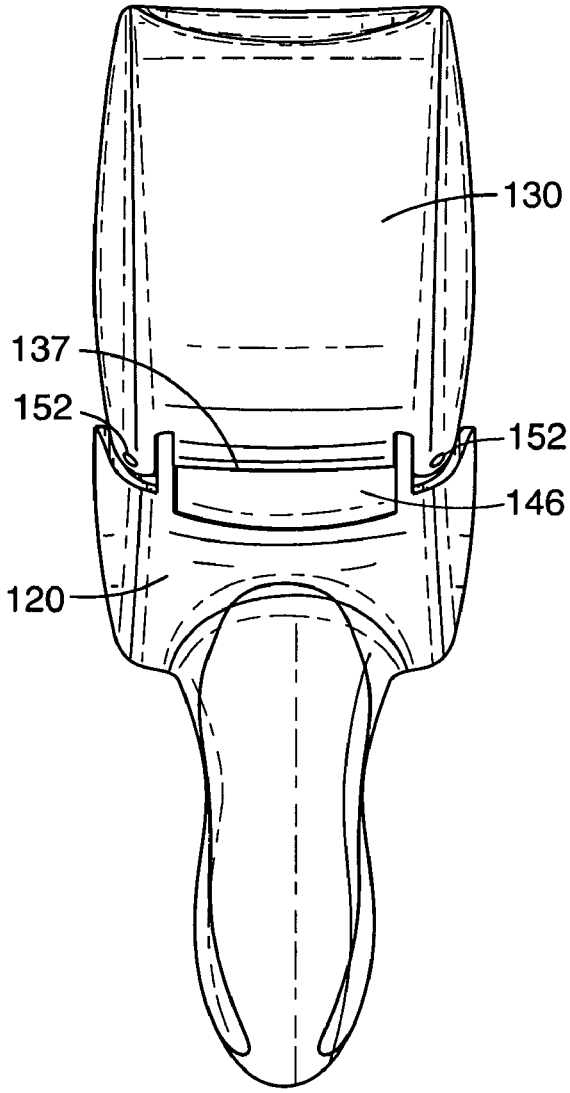
FIG. 6 is a rear view of the tape dispenser of FIG. 3.

As can be seen in FIGS. 4, 5, and 6, the cover includes a push plate 137 adjacent the pivot end 114 and adjacent the cover pivot opening 138. Also shown in FIGS. 4, 5, and 6, the mandrel 140 includes a rear face plate 146 adjacent the pivot end 114 and adjacent the mandrel pivot opening 148. When the cover 130 is rotated to an open position as shown in FIGS. 3 and 4, the push plate 137 on the cover 130 makes contact with the rear face plate 146 of the mandrel 140 and forces the mandrel 140 to remain in the open position as shown in FIG. 3.

FIGS. 5 and 6 depict a rear view of the interaction of the push plate 137 of the cover 130 and the rear face plate 146 of the mandrel 140. In FIG. 5, the housing 110 of the tape dispenser 100 is in a closed position, as shown in FIG. 1. In the closed position, the push plate 137 is not in direct contact with the rear face plate 146. However, upon opening the housing 110 of the tape dispenser 100, the push plate 137 makes direct contact with the rear face plate 146, as shown in FIG. 6. Movement of the cover 130 to the open position directly causes the mandrel 140 to actuate and remain in the open position, as shown in FIG. 3. With the cover 130 open, the mandrel 140 will not return to a nested position within the base 120.

In one embodiment, a pivot restraint 128 is included on the base pivot projection 126. The pivot restraint 128 mechanically interacts with the mandrel 140 to prevent further rotation of the mandrel 140 beyond the open position. The mandrel 140 will not be capable of continuing to rotate and nest entirely within the cover. Instead, the mandrel 140 will remain in the position shown in FIG. 3 until the cover 130 is closed and the push plate 137 disengages with the rear face plate 146.

In the embodiment of the invention shown in FIGS. 1-6 the tape dispenser 100 includes a handle 160. As shown, the handle 160 projects from the base 120 and preferably includes a first grip 162 and a second grip 164, separate from the first grip 162 and opposite the first grip 162. The first and second grip 162, 164 are preferably a soft, resilient plastic material to help in comfortably securing the tape dispenser 100 in a user's hand. It is understood that a handle 160 is optional and not a necessary component of the tape dispenser 100.

To load the tape dispenser 100, the cover 130 is released from the base 120 by disengaging the lock projections 136 from the lock openings 124 of the base 120. Then, the cover 130 is able to rotate about the pivot pin 152 to an open position as shown in FIG. 3. During opening the cover 130, the push plate 137 of the cover 130 contacts the rear face plate 146 of the mandrel 140 to cause the mandrel 140 to also rotate about the pivot pin 152 to an open position as shown in FIG. 3. Pivot restraint 128 on the base pivot projection 126 prevents the mandrel 140 from rotating beyond the open position shown in FIG. 3.

With the spindle 142 of the mandrel 140 accessible, a roll of tape (not shown) is inserted onto the spindle 142. The film of tape is pulled from the spindle 142 along the guide 144 and beyond the wipe down ridge 145. The non-adhesive side of the tape film extends along the guide 144 surface.

Following loading of the tape, the cover 130 is closed, as shown in FIG. 1. Closing the cover 130 will push the mandrel 140 within the base 120. The lock projections 136 enter lock openings 124 to securely close the cover 130 over the base 120 to return the tape dispenser 100 to a closed position as shown in FIG. 1, but with tape loaded within the tape dispenser 100.

To use the tape dispenser 100, the user holds the handle 160, if included, as shown in FIG. 2. Alternatively, the user may hold the housing 110 and more particularly may hold the cover 130 of the housing 110 if a handle is not included. The tape 200 discharges from the tape discharge end 112 of the tape dispenser 100. The wipe down ridge 145 provides a surface on the tape dispenser 100 to assist with added frictional force to ensure contact between the tape 200 and the surface that the tape 200 is being adhered to. As shown in FIG.

1, but not visible from the side view in FIG. 2, a blade 135 is included to cut the tape 200. Upon rotation of the tape dispenser 100 with respect to the surface the tape 200 is being adhered to, the blade 135 will make contact with the tape 200 and cut the tape 200.

Protrusions 125 may also be included on the base 120 at the tape discharge end 112. The protrusions 125 provide a plurality of raised surfaces that make contact with the adhesive side of the tape 200 at the tape discharge end 112. Having an intermittent surface, instead of a smooth continuous surface, that makes contact with the adhesive side of the tape, limits the adhesion of the tape 200 to the dispenser.

Reference to upper, lower, top, bottom, left and right are for reference purposes only with respect to the embodiment of the tape dispenser 100 shown and described in FIG. 1-6 and are not intended to be limiting.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A tape dispenser including a cutting mechanism, the tape dispenser comprising:
- a base including a pivot restraint;
- a cover capable of securely engaging with the base and including a push plate; and
- a mandrel disposed within the base and cover;
- wherein the base, the cover, and the mandrel are connected along a pivot point;
- wherein the push plate of the cover actuates the mandrel to an open, loading position and the pivot restraint mechanically interacts with the mandrel to prevent rotation of the mandrel beyond the open, loading position; and
- wherein the push plate prevents the mandrel from nesting within the base when the cover is in the open, loading position.

2. The tape dispenser of claim 1, wherein the base includes a handle.

3. The tape dispenser of claim 1, wherein the base includes a lock opening and the cover includes a lock projection for engaging with the lock opening for securely engaging the cover with the base.

4. The tape dispenser of claim 1, wherein the cover includes a planar surface adjacent the cutting mechanism.

5. The tape dispenser of claim 1, further comprising a pivot pin extending through an opening in the base, cover, and mandrel to pivotally connect the base, cover and mandrel.

6. The tape dispenser of claim 1, wherein the mandrel includes a rear face plate adjacent the pivot point that the cover engages with to actuate the mandrel to an open, loading position.

7. A tape dispenser including a cutting mechanism, the tape dispenser comprising:
- a base including a pivot restraint; and
- a cover capable of engaging with the base and including a push plate;
- a tape discharge end when the cover is engaged with the base; and
- a mandrel disposed within the base and cover and including a spindle for supporting a roll of tape and a rear face plate;
  - wherein the base, cover and mandrel are connected along a pivot point distal the tape discharge end;
  - wherein when the push plate of the cover contacts the rear face plate of the mandrel, the cover actuates the mandrel to an open, loading position and the pivot restraint mechanically interacts with the mandrel to prevent rotation of the mandrel beyond the open, loading position; and
  - wherein the push plate prevents the mandrel from nesting within the base when the cover is in the open, loading position.

8. The tape dispenser of claim 7, wherein the base includes a handle.

9. The tape dispenser of claim 7, wherein the base includes a lock opening and the cover includes a lock projection for engaging with the lock opening for securely engaging the cover with the base.

10. The tape dispenser of claim 7, further comprising a pivot pin at the pivot point to pivotally connect the base, cover and mandrel.

11. A tape dispenser comprising:
- a housing comprising:
  - (i) a base having a bottom surface and two projecting sidewalls further includes a lock opening and a handle;
  - (ii) a cover having a top surface and two projecting sidewalls further includes a cutting mechanism, a lock projection that is capable of engaging with the lock opening, and a push plate; and
  - (iii) a tape discharge end adjacent the cutting mechanism when the cover and base are engaged; and
- a mandrel disposed within the housing including a spindle for supporting a roll of tape and a rear face plate;
- wherein the base, cover and mandrel are connected along a pivot point opposite the tape discharge end;
- wherein the push plate of the cover contacts the rear face plate of the mandrel to actuate the mandrel between a closed, dispensing position and an open, loading position;
- wherein the base includes a pivot restraint that mechanically interacts with the mandrel to prevent rotation of the mandrel beyond the open, loading position; and
- wherein the push plate prevents the mandrel from nesting within the base when the cover is in the open, loading position.

12. The tape dispenser of claim 11, further comprising a pivot pin at the pivot point to pivotally connect the base, cover and mandrel.

* * * * *

UNITED STATES PATENT AND TRADEMARK OFFICE

CERTIFICATE OF CORRECTION

PATENT NO. : 8,042,592 B2
APPLICATION NO. : 11/390011
DATED : October 25, 2011
INVENTOR(S) : Dennis L Crawford It is certified that error appears in the above-identified patent and that said Letters Patent is hereby corrected as shown below:

Column 2

Line 37, delete "1 10" and insert -- 110 --, therefor.

Line 41, delete "1 10" and insert -- 110 --, therefor.

Signed and Sealed this
Twelfth Day of February, 2013

Teresa Stanek Rea
*Acting Director of the United States Patent and Trademark Office*